US009666948B1

(12) United States Patent
Rao et al.

(10) Patent No.: US 9,666,948 B1
(45) Date of Patent: May 30, 2017

(54) COMPACT CROSS-LINK ANTENNA FOR NEXT GENERATION GLOBAL POSITIONING SATELLITE CONSTELLATION

(71) Applicant: NORTHROP GRUMMAN SYSTEMS CORPORATION, Falls Church, VA (US)

(72) Inventors: Sudhakar K. Rao, Rancho Palos Verdes, CA (US); Sebong Chun, Orange, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 9 days.

(21) Appl. No.: 15/013,561

(22) Filed: Feb. 2, 2016

(51) Int. Cl.

| | |
|---|---|
| ***H01Q 21/00*** | (2006.01) |
| ***H01Q 11/08*** | (2006.01) |
| ***H01Q 1/36*** | (2006.01) |
| ***H01Q 21/06*** | (2006.01) |
| ***H01Q 21/28*** | (2006.01) |
| ***H01Q 1/28*** | (2006.01) |

(52) U.S. Cl.
CPC ..... *H01Q 11/08* (2013.01); *H01Q 1/288* (2013.01); *H01Q 1/362* (2013.01); *H01Q 21/061* (2013.01); *H01Q 21/28* (2013.01)

(58) Field of Classification Search
CPC ..... H01Q 11/08; H01Q 1/288; H01Q 1/362; H01Q 21/061
USPC ..... 343/893
See application file for complete search history.

(56) References Cited

U.S. PATENT DOCUMENTS

| | | | |
|---|---|---|---|
| 5,572,227 | A | 11/1996 | Pal et al. |
| 5,920,292 | A | 7/1999 | O'Neill, Jr. |
| 6,181,286 | B1 | 1/2001 | Roscoe et al. |
| 6,288,686 | B1 | 9/2001 | Josypenko |
| 6,421,028 | B1 | 7/2002 | Öhgren et al. |
| 6,483,471 | B1 | 11/2002 | Petros |
| 6,535,179 | B1 | 3/2003 | Petros |
| 6,653,987 | B1 | 11/2003 | Lamensdorf et al. |
| 6,806,845 | B2 | 10/2004 | Fund et al. |
| 8,022,890 | B2 | 9/2011 | Bondyopadhyay |
| 8,681,070 | B2 | 3/2014 | DiNallo et al. |
| 8,836,600 | B2 | 9/2014 | Lafleur |

OTHER PUBLICATIONS

Rao, Basrur Rama, "FRPAs and High-Gain Directional Antennas", GPS/GNSS Antennas, Chapter 2 , pp. 63-156.

*Primary Examiner* — Graham Smith
(74) *Attorney, Agent, or Firm* — John A. Miller; Miller IP Group, PLC

(57) ABSTRACT

An inter-satellite cross-link antenna for a communications satellite in a constellation of satellites in earth orbit. The complete cross-link system is an array of eight quadrifilar helix antennas with a new design which is eight times smaller than previous designs, and has superior inter-satellite communications performance. The quadrifilar helix antenna is designed with a length, diameter, helix pitch angle and ground plate connectivity which is matched to the UHF inter-satellite communication frequency to provided a toroidal radiation pattern with high signal strength in a direction normal to the antenna axis and very low signal strength in an axial direction. The array of eight quadrifilar helix antennas does not require interleaving with the L-band GPS antenna aperture on the satellite, and does not block or interfere with the earth-directed GPS signals.

20 Claims, 8 Drawing Sheets

COMPACT CROSS-LINK ANTENNA FOR NEXT GENERATION GLOBAL POSITIONING SATELLITE CONSTELLATION

BACKGROUND

Field

This invention relates generally to an antenna subsystem for a communications satellite and, more particularly, to a cross-link antenna for satellite-to-satellite communications in a constellation, where the cross-link antenna comprises eight quadrifilar helices situated in a ring around an L-band satellite-to-earth antenna, and the quadrifilar helices have a smaller and more effective design which improves both satellite-to-satellite and satellite-to-earth communications performance.

Discussion

Communications satellites are used to enable many different types of telecommunications. For fixed (point-to-point) services, communications satellites provide a microwave radio relay technology which is complementary to that of communication cables. Communications satellites are also used for mobile applications such as communications to ships, vehicles, planes and hand-held terminals, global positioning system (GPS), and for TV and radio broadcasting.

In one common implementation, many communications satellites are placed in low earth orbit (LEO) or medium earth orbit (MEO) in a constellation which circles the earth. The individual satellites in the constellation communicate with each other, and also communicate with users and communications providers on or near the earth's surface. The communications among the satellites in the constellation are handled by what are known as inter-satellite links (ISL) or cross-links.

Some satellite constellations use reflector-type antennas for ISL or cross-link, however these types of antennas and their control systems are expensive and bulky. It is desirable, where possible, to use simpler antennas for cross-link communications. However, the cross-link antennas must not only be effective in satellite-to-satellite communications performance, but must also not be detrimental to satellite-to-earth communications performance. These requirements have been difficult if not impossible to meet using past cross-link antenna designs.

DETAILED DESCRIPTION OF THE EMBODIMENTS

The following discussion of the embodiments of the invention directed to a quadrifilar helical inter-satellite cross-link antenna is merely exemplary in nature, and is in no way intended to limit the invention or its applications or uses. For example, the embodiments discussed below are described in the context of a constellation of global positioning system (GPS) satellites. However, the disclosed antenna may also be suitable for use in other types of satellites or other types of communications systems.

Figure 1:
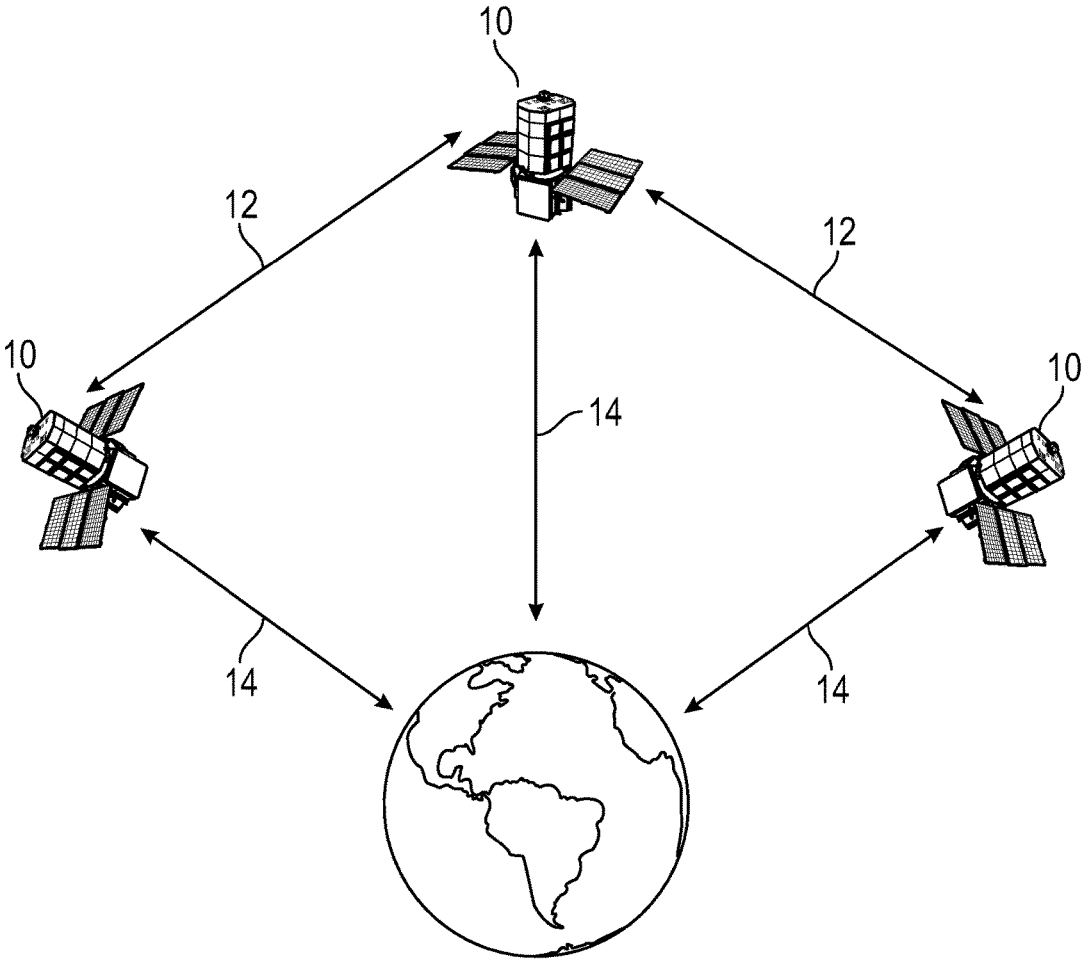
FIG. 1 is an illustration of a constellation of satellites circling earth, showing both satellite-to-satellite and satellite-to-earth communications.

FIG. 1 is an illustration of a constellation of satellites 10 circling earth. Three of the satellites 10 are shown in FIG. 1. In an actual constellation, many more of the satellites 10 would be used—possibly eight to ten, or more. The individual satellites in the constellation communicate with each other, and also communicate with users and communications providers on or near the earth's surface. The communications among the satellites in the constellation are handled by what are known as inter-satellite links (ISL) or cross-links. FIG. 1 shows both satellite-to-satellite cross-link communications signals 12 and satellite-to-earth communications signals 14.

Different types of cross-link antennas have been developed for satellite-to-satellite communications. One type of cross-link antenna uses a reflector to send and receive a highly directional communication signal. Reflector type antennas have good cross-link communications performance, but are bulky and expensive to deploy on a satellite, particularly due to the need to steer the reflector for precise aiming. Another type of cross-link antenna is an omni-directional, non-steerable design which can be much less expensive to construct and deploy.

Figure 2:
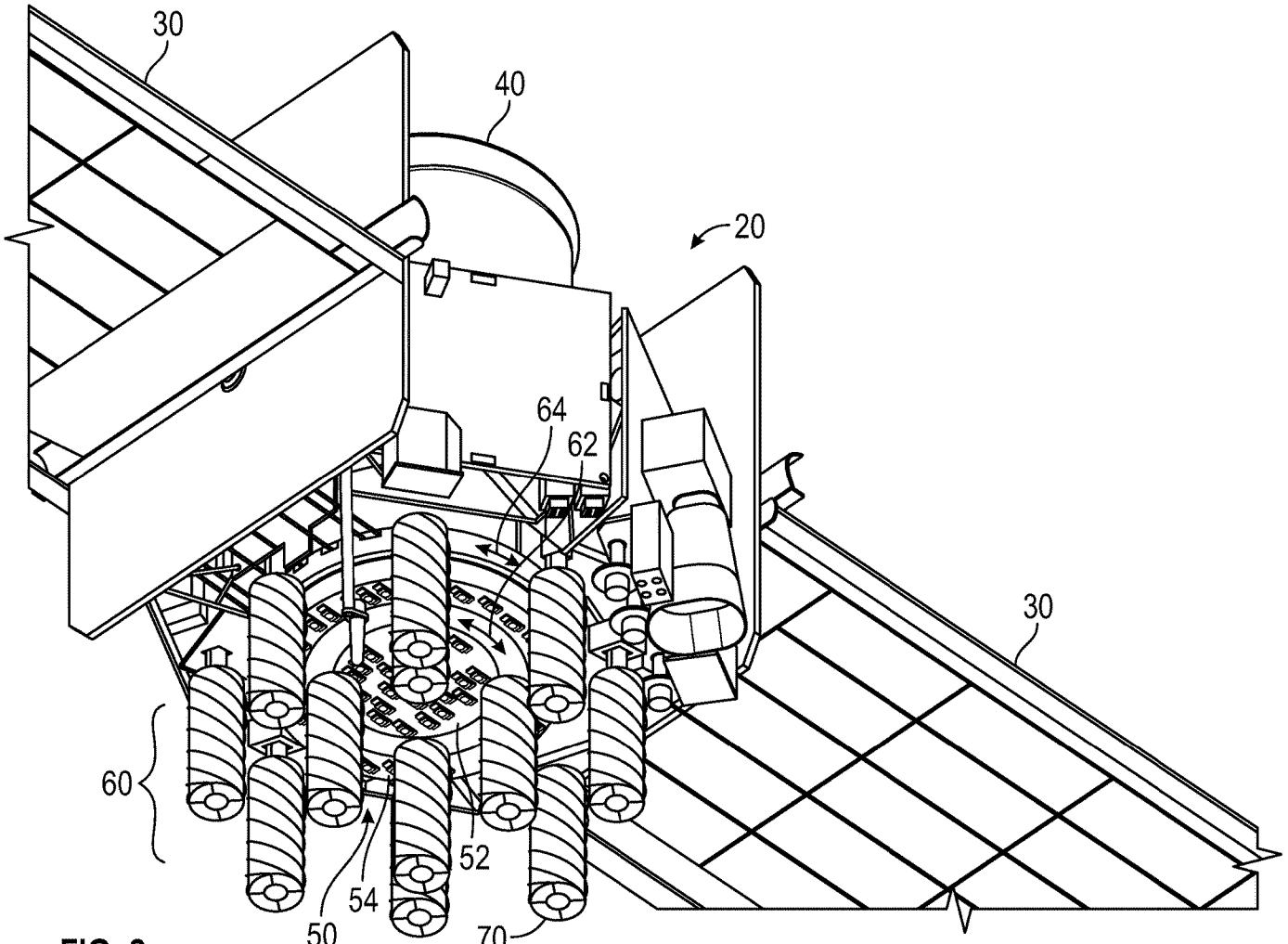
FIG. 2 (Prior Art)
FIG. 2 is an illustration of a communications satellite with a known design of satellite-to-satellite cross-link and satellite-to-earth antennas.

FIG. 2 is an illustration of a communications satellite 20 with a known design of non-steerable satellite-to-satellite cross-link antennas. The satellite 20 includes solar panels 30 mounted to a hub 40, as would be understood by those skilled in the art. The hub 40 contains the communications and control systems onboard the satellite 20. In particular, the hub 40 includes an L-band antenna 50—which transmits radio signals "down" toward earth, and a cross-link antenna 60—which transmits and receives UHF signals with other satellites in the constellation. In this example, the satellite 20 is a global positioning system (GPS) satellite; GPS signals typically fall within the L-band, defined by IEEE as the 1-2 GHz range of the radio spectrum. For various performance and packaging reasons, the cross-link antenna 60 shares space with the L-band antenna 50 on the earth-facing deck of the hub 40.

In the known design employed on the satellite 20, the L-band antenna 50 and the cross-link antenna 60 each consist of multiple sections. The L-band antenna includes a central aperture 52 and an intermediate ring 54. The cross-link antenna 60 includes an inner ring 62 and an outer ring 64. The inner ring 62 includes four quadrifilar helical antennas 70, while the outer ring 64 includes eight of the quadrifilar helical antennas 70. It can be seen in FIG. 2 that the sections of the L-band antenna 50 and the cross-link antenna 60 are interleaved. That is, the central aperture 52 (L-band) is in the center, surrounded by the inner ring 62 (cross-link), which is surrounded by the intermediate ring 54 (L-band), which in turn is surrounded by the outer ring 64 (cross-link).

The L-band antenna 50 transmits a cone-shaped radiation pattern toward earth. The cone is typically required to cover +/−14°, or a 28° opening angle of the cone. Because of the interleaving of the sections of the L-band antenna 50 and the cross-link antenna 60, and the relatively large size of the quadrifilar helical antennas 70, the satellite 20 is known to suffer significant degradation in the L-band signal, especially in coverage areas which are not near the axis of the cone. This L-band signal degradation is due to the physical blockage of the L-band signal by the quadrifilar helical antennas 70. The L-band signal degradation is undesirable, as it either results in poorer GPS receiver performance for users, or requires an increase in the number of satellites in the constellation in order to improve performance.

Figure 3:
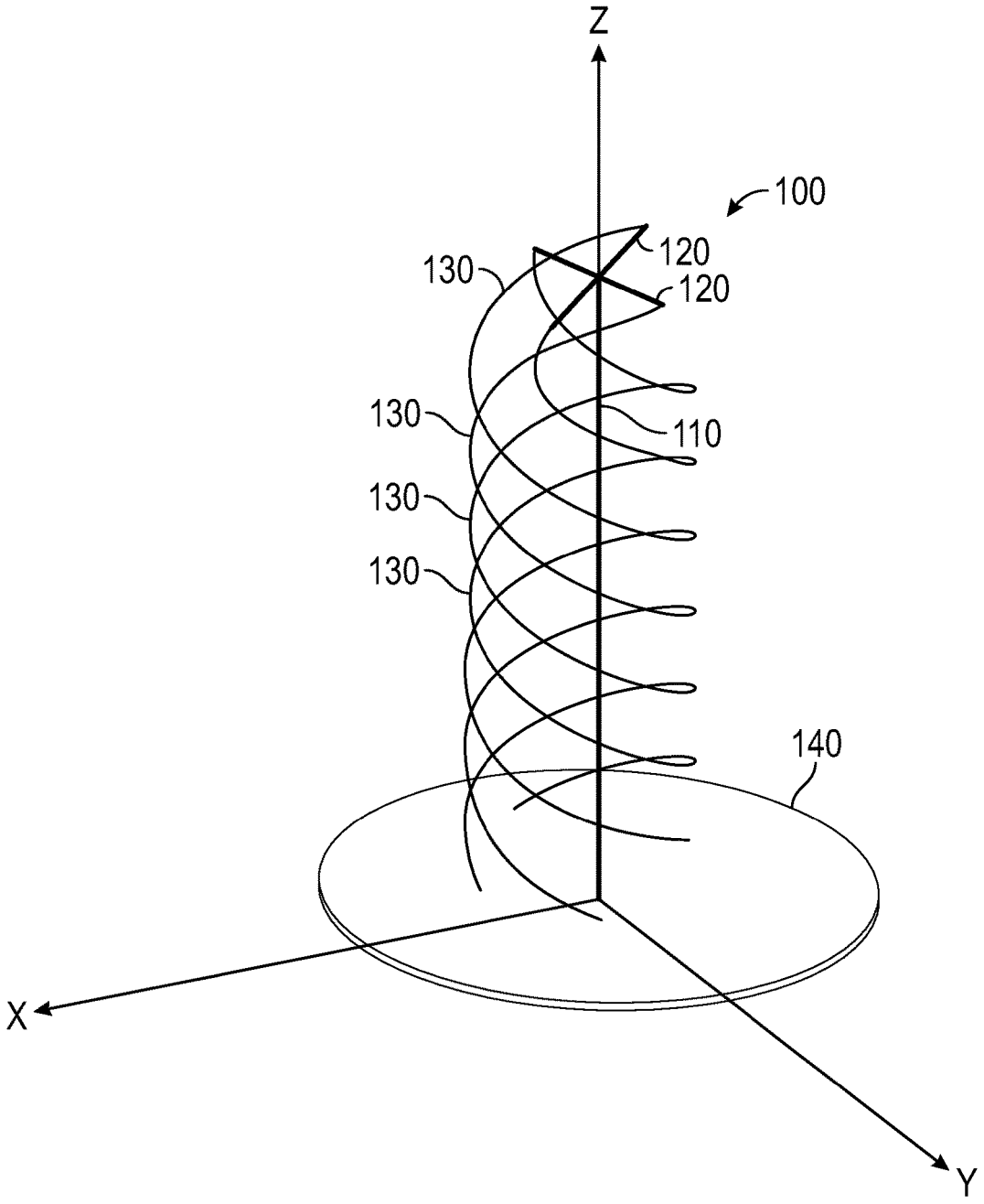
FIG. 3 is an illustration of a new design of a quadrifilar helix antenna which can be used for satellite-to-satellite cross-link communications.

FIG. 3 is an illustration of a new design of a quadrifilar helix antenna 100 which can be used for satellite-to-satellite cross-link communications. The quadrifilar helix antenna 100 has a design which provides better cross-link communications performance than previous designs, and also enables improved cross-link and L-band antenna packaging on a satellite—thereby improving L-band communications performance.

The antenna 100 is shown in FIG. 3 with a local X/Y/Z coordinate frame, where the local Z axis is the axis of the helix and positive Z points toward earth when the antenna 100 is in position on an orbiting satellite. The antenna 100 is comprised of a center feed wire 110, four end branches 120, four helical filaments 130 and a ground plate 140. The feed wire 110 is preferably a coaxial cable which connects the antenna 100 with a communications controller on the satellite.

The coaxial cable/feed wire 110 carries transmission signals from the communications controller to be transmitted by the antenna 100, and carries received signals from the antenna 100 back to the communications controller. The feed wire 110 is split to connect to the four end branches 120, each of which is connected to an end of one of the helical filaments 130 as shown. The feed wire 110 may be split such that one opposing pair of the end branches 120 is coupled to the inner conductor of the coaxial cable, and the other opposing pair of end branches 120 is coupled to the outer shield of the coaxial cable. The ends of the four helical filaments 130 opposite the end branches 120 are coupled to the ground plate 140.

In one preferred embodiment, the quadrifilar helix antenna 100 has a height (in the Z direction—from the ground plate 140 to the end branches 120) of 12" (inches), and a diameter of 5". The helical filaments 130 have a pitch angle of 20°, and are made of a wire with a diameter of 0.1". As stated above, the filaments 130 are shorted to the ground plate 140, which has a diameter of 10". This embodiment has been designed for optimal performance in a satellite-mounted array of the quadrifilar helical antennas 100 as discussed further below.

Figure 4A:
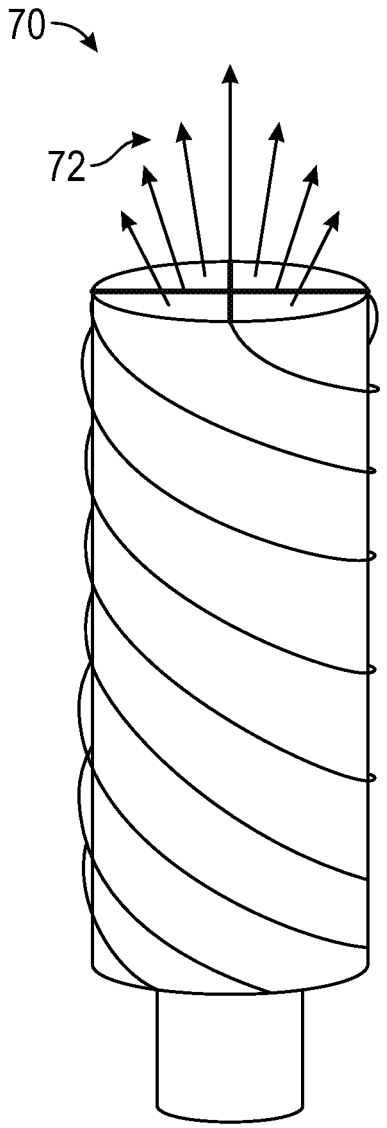
FIGS. 4 A and B are illustrations of old and new designs of quadrifilar helix antennas showing both size difference and difference in radiation patterns of the two designs.
Figure 4B:
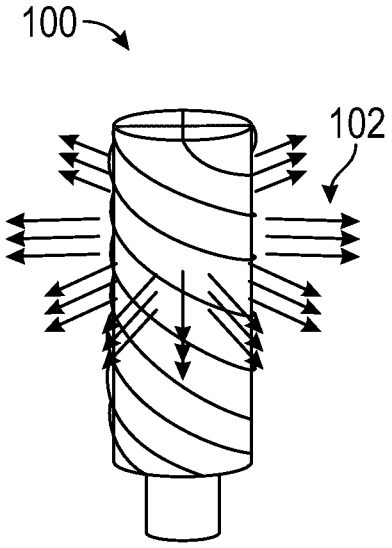

FIGS. 4 A and B are illustrations of old and new designs of quadrifilar helix antennas showing both size difference and difference in radiation patterns of the two designs. FIG. 4A shows the quadrifilar helix antenna 70 of FIG. 2, while FIG. 4B shows the quadrifilar helix antenna 100 of FIG. 3. The antenna 70 has a height of 24" and a diameter of 10", while the antenna 100 has a height of 12" and a diameter of 5". Thus, the new design of the antenna 100 is half the height and half the diameter of the old design of the antenna 70. Because the volume of a cylinder is a function of height times diameter squared, it can be seen that the new design of the antenna 100 has a volume which is one-eighth that of the antenna 70. The much smaller size of the antenna 100 results in much less interference with the L-band transmission signal.

Furthermore, the reduced diameter of the antenna 100 causes a change in its radio signal radiation pattern compared to the antenna 70. In the application described above, the cross-link communications between satellites in a constellation are in the UHF band at 260 MHz (megahertz). A 260 MHz signal has a wavelength of approximately one meter. The old design of the antenna 70, with its circumference being close to the one meter wavelength value, operates in an axial or "end-fire" mode, where a radiation pattern 72 emanates predominantly from the open end of the antenna 70. The new design of the antenna 100, with its circumference being much smaller than the one meter wavelength value, operates in an omnidirectional normal mode, where a toroidal radiation pattern 102 produces substantially equal power in all directions perpendicular to the axis of the antenna 100. The toroidal radiation pattern 102 of the antenna 100 not only delivers much more signal power in the 60°-120° elevation angle range where other satellites in the constellation exist, it also delivers almost no signal power toward earth where it is not wanted.

Figure 5:
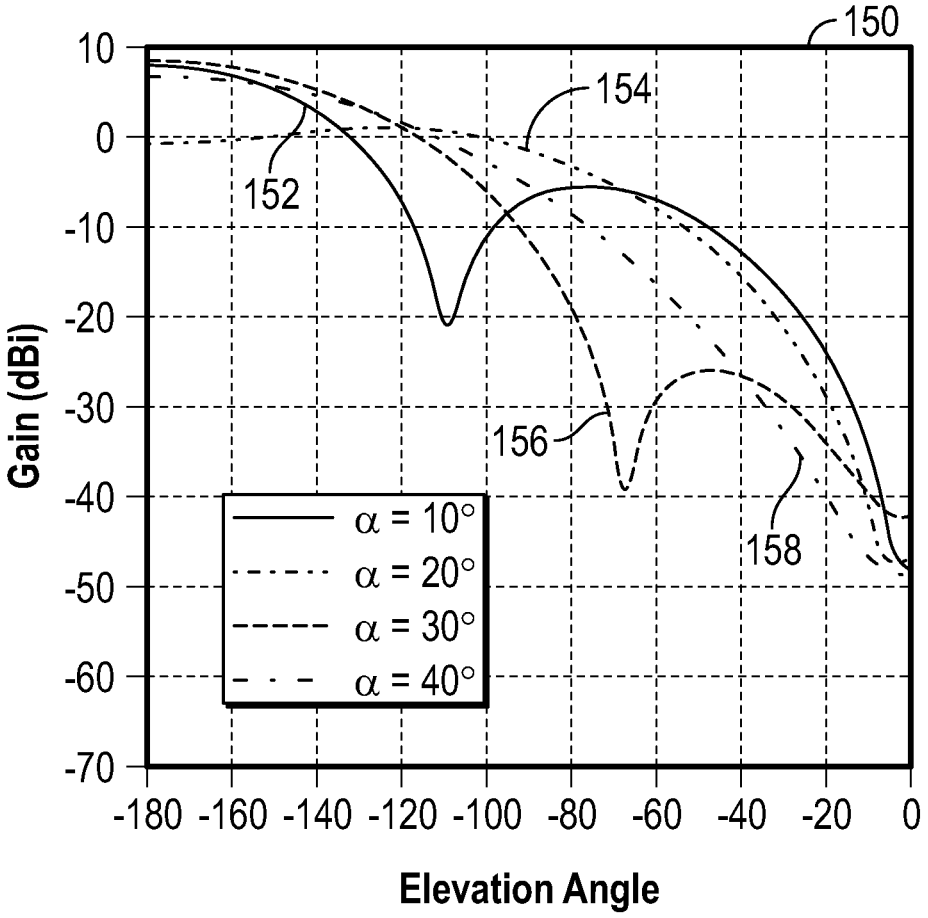
FIG. 5 is a graph showing radio signal gain as a function of elevation angle for the new design of quadrifilar helix antenna of FIG. 3, for a range of helix pitch angles.

FIG. 5 is a graph 150 showing radio signal gain curves as a function of elevation angle for the new quadrifilar helix antenna 100, for a range of helix pitch angles. The horizontal axis represents elevation angle θ, while the vertical axis represents gain (dBi). Curves 152, 154, 156 and 158 show the gain for helix angles of 10°, 20°, 30° and 40°, respectively, as indicated by the legend and the line fonts. The curves on the graph 150 are based on measured data for the quadrifilar helix antenna 100 with the size and properties described above (12" length; 5" diameter; filaments shorted to ground plate 140).

The first thing to notice about the curves on the graph 150 is that they all drop off substantially below about 20° elevation angle (where the 0° elevation angle is straight "down"—toward earth). This is because, as discussed above, the antenna 100 is designed as a normal mode antenna with the toroidal radiation pattern 102. The fact that very little radio signal power emanates from the end of the antenna 100 is expected and is desirable. The quadrifilar helix antenna 100 is designed to have a gain in the normal direction which is at least 40 dBi greater than in the axial direction.

It can also be seen on the graph 150 that antenna performance varies dramatically with helix pitch angle. Specifically, the 10° pitch helix (curve 152) exhibits a large dip in signal gain at an elevation angle of about 110° (from 80°-140°), which overlaps with the visibility window to other satellites in the constellation; this translates to an undesirable reduction in satellite-to-satellite communication performance. Similarly, the 30° pitch helix (curve 156) exhibits a large dip in signal gain at an elevation angle of about 65° (from 20°-120°), which also overlaps with the visibility window to other satellites in the constellation and translates to an undesirable reduction in satellite-to-satellite communication performance.

However, the 20° pitch helix (curve 154) exhibits no dip in signal gain in the elevation angle range of interest. In addition, the 20° pitch helix provides the highest gain of any pitch angle in the 80°-100° elevation angle range of primary importance. Higher pitch angles, such as 40° (curve 158) and higher (not shown) delivered less performance in the 80°-100° elevation angle range. Thus, the 20° pitch helix is chosen as optimal for the design of the quadrifilar helix antenna 100.

Figure 6:
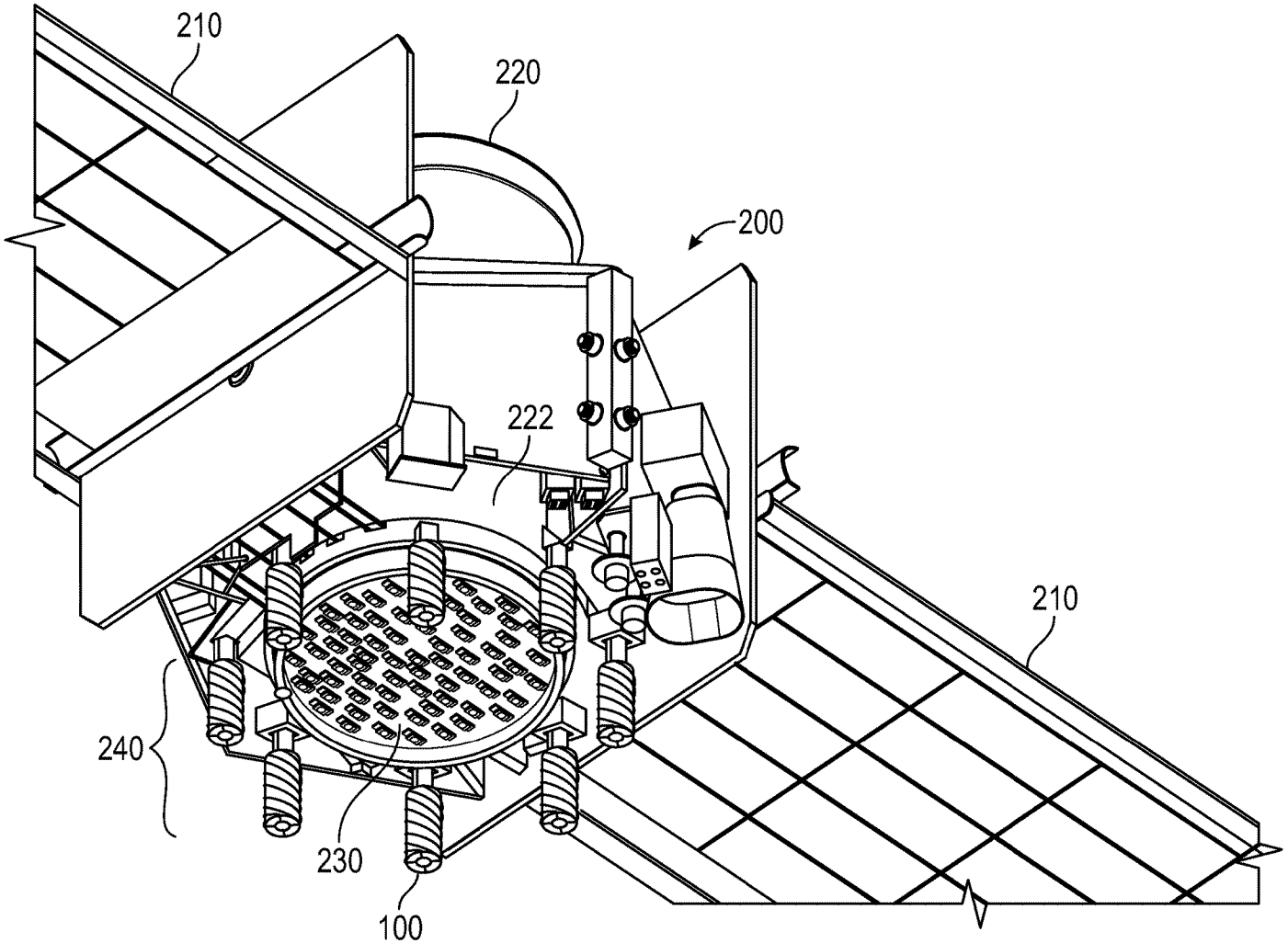
FIG. 6 is an illustration of a communications satellite with the new design of quadrifilar helix antenna which improves both satellite-to-satellite cross-link and satellite-to-earth communications performance.

FIG. 6 is an illustration of a communications satellite 200 with the new design of the quadrifilar helix antenna 100 which improves both satellite-to-satellite cross-link and satellite-to-earth communications performance. As did the satellite 20 of FIG. 2 discussed previously, the satellite 200 includes solar panels 210 and a hub 220. The hub 220 includes an earth-facing deck 222, on which an L-band aperture 230 and a cross-link array 240 are mounted. The L-band aperture 230—which could instead be any other type of satellite-to-earth antenna—is a single circular element, as opposed to the central aperture 52 and the intermediate ring 54 of the satellite 20. The simplification of the L-band aperture 230 is enabled by the smaller footprint of the cross-link array 240 owing to the smaller number and size of the antennas 100, which is in turn enabled by the improved performance of the quadrifilar helix antennas 100.

The cross-link array 240 includes eight of the quadrifilar helix antennas 100 arranged in a ring surrounding the L-band aperture 230. Only eight of the quadrifilar helix antennas 100 are required on the satellite 200, where twelve of the helix antennas 70 were required on the previous satellite 20. Considering the smaller number of the quadrifilar helix antennas 100, and their smaller size (each antenna 100 has 8× less volume than the antenna 70), it is apparent that the satellite 200 offers over an order of magnitude reduction in cross-link antenna volume, while at the same time providing improved cross-link communications performance.

The eight quadrifilar helix antennas 100 in the cross-link array 240 communicate with a communications controller (not shown) in the hub 220 via coaxial cable, as discussed previously. A simple splitter/combiner can be used to terminate the eight coaxial cables at the controller. Alternatively, in some cases it may be advantageous to provide a separate connection for each of the eight coaxial cables to the controller, where the eight cables could carry transmission signals with different phasing or other differences.

The satellite 200, with the L-band aperture 230 and the cross-link array 240 of eight quadrifilar helix antennas 100, demonstrates superior performance in every way as compared to legacy systems. First, the L-band signal directed toward earth by the satellite 200 suffers less interference than with previous designs, which are known to cause an L-band signal degradation of more than 1.5 dB. In contrast, the L-band signal from the new design of the satellite 200 has negligible degradation. The L-band signal improvements of the satellite 200 are due to three factors—the reduced physical size of the quadrifilar helix antennas 100, the elimination of interleaving between L-band and cross-link arrays, and the reduction of undesirable UHF radiation directed toward earth—all of which are made possible by the new design of the quadrifilar helix antennas 100.

Second, the satellite 200 provides better cross-link communications performance than previous designs, due to the optimization of the toroidal radiation pattern 102 from the quadrifilar helix antennas 100 to deliver the greatest signal strength in the 80-100° elevation angle window where it is needed. Because of the normal mode antenna characteristic and the toroidal radiation pattern 102, fewer of the quadrifilar helix antennas 100 are needed on the satellite 200 than on previous designs. Finally, the cross-link communications performance of the satellite 200 is extremely robust with respect to azimuth angle.

Figure 7:
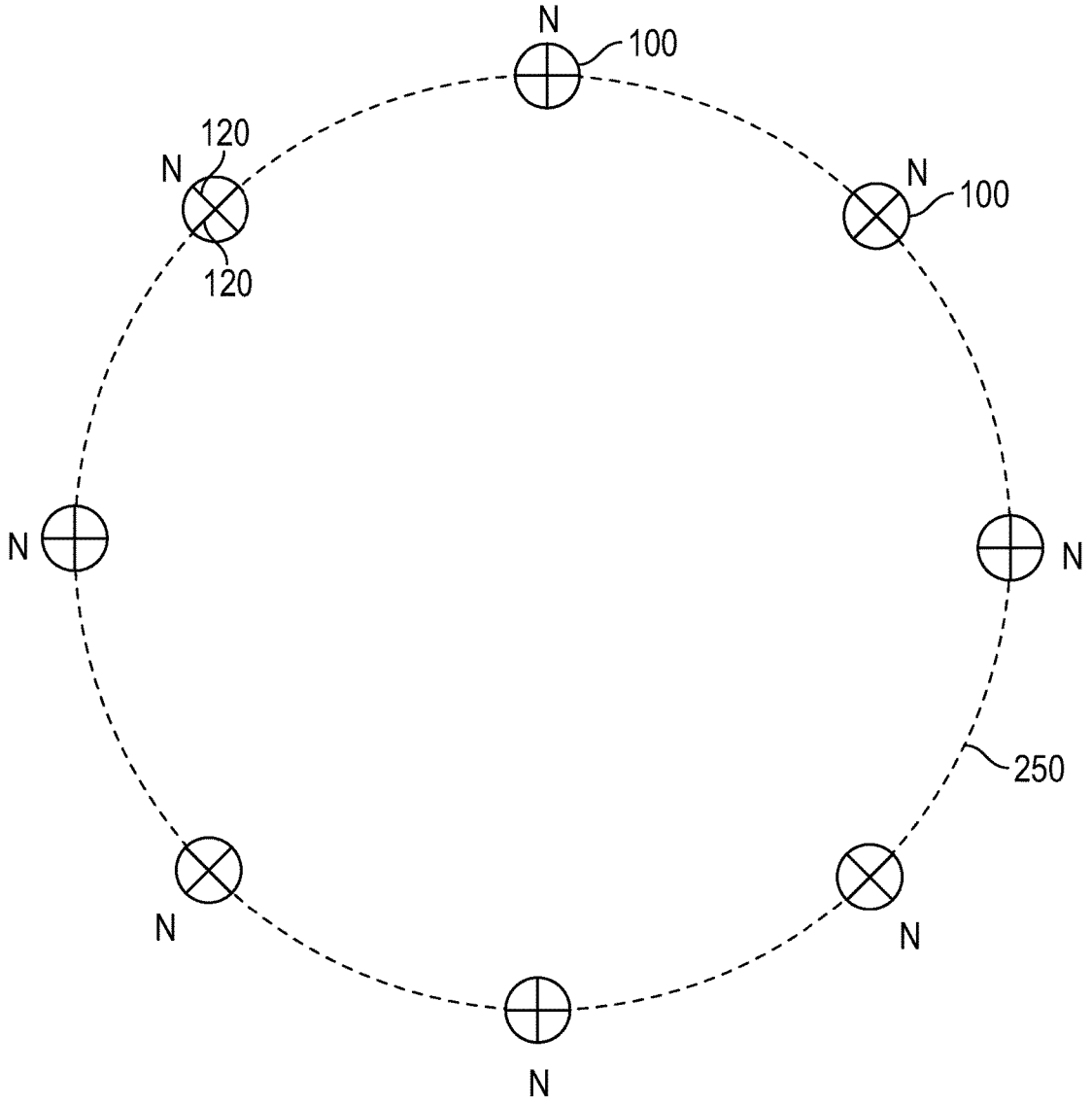
FIG. 7 is a diagram showing the layout of the eight quadrifilar helix antennas on the satellite of FIG. 6.

FIG. 7 is a diagram showing the layout of the eight quadrifilar helix antennas 100 in the cross-link array 240, on the satellite 200 of FIG. 6. As described above, the antennas 100 have a diameter of 5". In a preferred embodiment, the eight antennas 100 in the cross-link array 240 are arranged in a circular pattern (circle 250) with a diameter of 66". The eight antennas 100 are positioned at 45° intervals around the circle 250. Recall from the discussion of FIG. 3 above that each of the antennas 100 includes four end branches 120 in two opposing pairs, and that the two opposing pairs may be wired differently. Thus, it may be important to control the orientation of the end branches 120—which in turn controls the orientation of the helical filaments 130.

In FIG. 7, the antenna 100 at the top-center of the page has its end branches 120 labeled with a "north" (N) direction pointing toward the top of the page, where the north direction may correspond, for example, to one of the end branches 120 which is coupled to the inner conductor of the coaxial cable. In one embodiment of the satellite 200, each of the antennas 100 is oriented according to its clock position on the circle 250—for example, such that the relative "north" of the end branches 120 is always pointed radially outward from the center of the circle 250, as shown in FIG. 7. In another embodiment, the antennas 100 are all identically oriented—such that the relative "north" of the end branches 120 are all pointed in the same direction (parallel). The orientation of the end branches 120 and the corresponding orientation of the helical filaments 130 may be chosen in a particular array design to achieve the optimum azimuth angle variation in signal strength around the satellite—where the optimum may be minimum variation around the 360° of azimuth angle, or the optimum may be a shaped pattern based on positions and orientations of the satellites 200 in their constellation.

Figure 8:
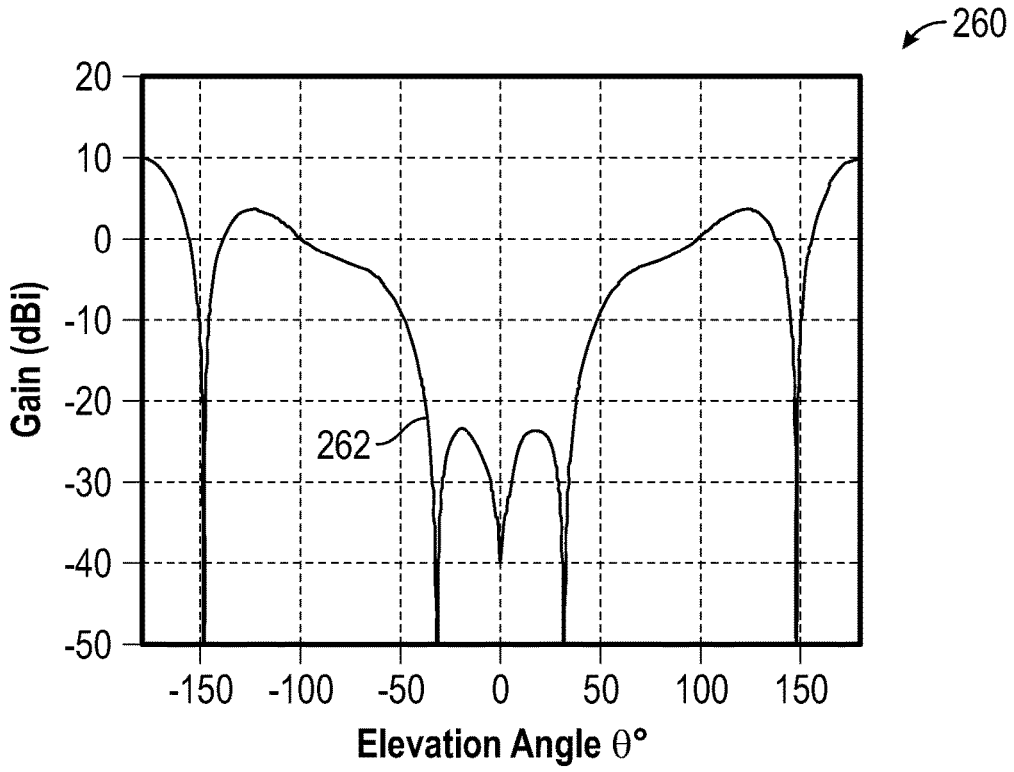
FIG. 8 is a graph showing radio signal gain as a function of elevation angle for the quadrifilar helix antenna array of FIG. 6.

FIG. 8 is a graph 260 showing radio signal gain as a function of elevation angle for the quadrifilar helix antenna cross-link array 240 of FIG. 6. Curve 262 shows that the signal gain drops off dramatically at 0° elevation angle (toward earth). This is desirable and expected performance for the cross-link array 240, as discussed above. The curve 262 also shows singularity points where the signal strength drops at about 30° and at about 150° elevation angles. These elevation angles are of no interest in cross-link communications between satellites. However, most significantly, the curve 262 also exhibits a broad shoulder of high signal gain in the 70°-90° elevation angle range (and on both sides of this range). It is the 70°-90° elevation angle which is most important in satellite-to-satellite cross-link communications in a constellation of satellites—as can be seen in the illustration of FIG. 1. The quadrifilar helix antennas 100 and the cross-link array 240 have been designed to provide the desired performance shown in FIG. 8—with very high signal strength in the 70°-90° elevation angle range where adjacent satellites in the constellation are located, and very low signal strength directed toward earth.

Figure 9:
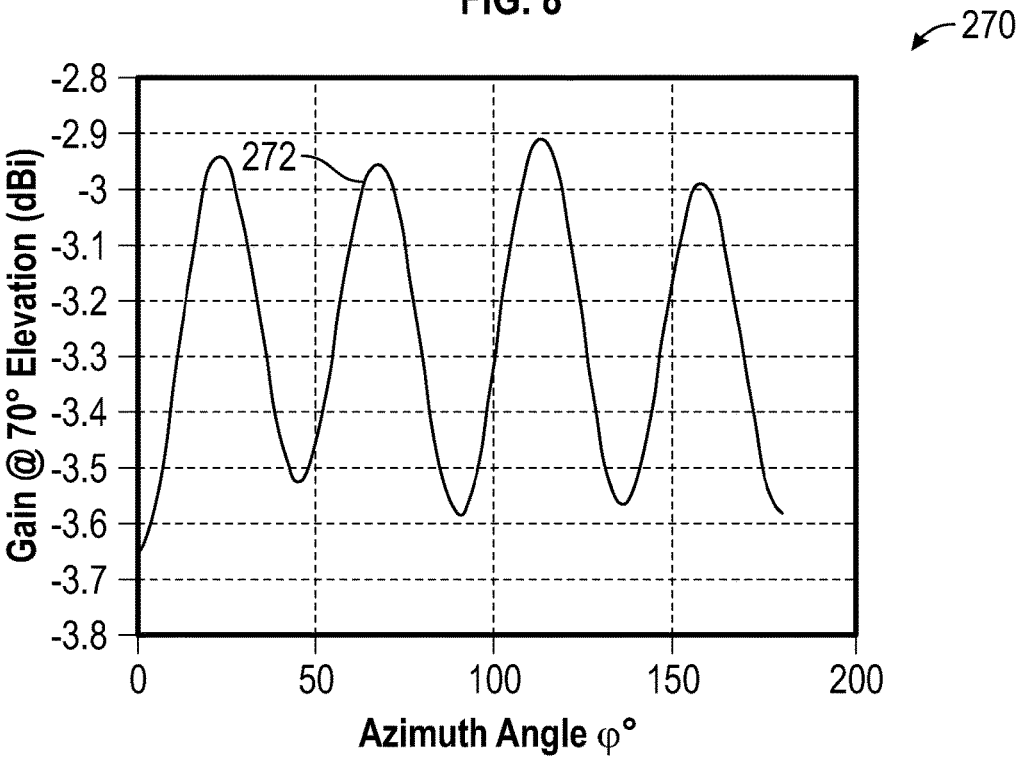
FIG. 9 is a graph showing radio signal gain as a function of azimuth angle for the quadrifilar helix antenna array of FIG. 6.

FIG. 9 is a graph 270 showing radio signal gain as a function of azimuth angle for the quadrifilar helix antenna cross-link array 240 of FIG. 6. The graph 270 shows gain vs. azimuth angle at an elevation angle of 70°—which is of primary interest for cross-link communications in a satellite constellation, as discussed above. Curve 272 depicts signal gain variation around one half-circumference of the satellite (0°-180°). It can be seen that the gain varies cyclically through four cycles around the half-circumference. This is expected performance, as the array includes eight of the quadrifilar helix antennas 100; thus, the signal gain rises and falls according to alignment with or between the four antennas 100 in the half-circumference. Most important in FIG. 9 are the actual gain values on the vertical axis. Azimuth gain variation is less than one dB, which is a very small amount, as desired. For comparison, note that the elevation gain variation of FIG. 8 covers a span of about 60 dB. The quadrifilar helix antennas 100 and the cross-link array 240 have been designed to provide the desired performance shown in FIG. 9—where signal strength variation is very small as a function of azimuth angle.

The inter-satellite cross-link antenna system described above provides numerous advantages over previous systems. These advantages include smaller and fewer quadrifilar helical antennas for cross-link communications, better cross-link communications performance due to normal mode antenna operation, simpler design of both the L-band and cross-link antenna systems due to elimination of interleaving, and better L-band transmission performance due to less interference from the cross-link antennas. This combination of features enables communication satellites to provide better performance while being made less expensive and less complex—all of which are favorable for telecommunications and other companies which employ communications satellites, and ultimately for the consumer.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A communications system for a satellite comprising:

an earth-directed antenna aperture on an earth-facing deck of the satellite; and a cross-link subsystem providing ultra-high frequency (UHF) communications between the satellite and other satellites in an earth-orbiting constellation, said cross-link subsystem comprising;

eight quadrifilar helix antennas equally spaced in a circular pattern surrounding the earth-directed antenna aperture, where each of the quadrifilar helix antennas has a central axis which is parallel to an aiming direction of the earth-directed antenna aperture and perpendicular to the earth-facing deck, and where each of the quadrifilar helix antennas includes;

a ground plate at a first end of the quadrifilar helix antenna proximal the earth-facing deck of the satellite;

a center feed wire located along the central axis and in communication with a communications controller onboard the satellite;

four wire filaments formed in a helical cylinder; and four end branches extending radially outward from the center feed wire at a second end of the antenna distal from the earth-facing deck, where each of the end branches connects one of the wire filaments to the center feed wire.

2. The communications system of claim 1 wherein the earth-directed antenna aperture is an L-band antenna transmitting global positioning system (GPS) signals toward earth.

3. The communications system of claim 2 wherein the GPS signals have a cone-shaped radiation pattern with a cone opening angle of 28 degrees.

4. The communications system of claim 3 wherein the eight quadrifilar helix antennas have a size and a location which causes them not to interfere with the GPS signals in the cone-shaped radiation pattern.

5. The communications system of claim 1 wherein the ground plate has a diameter of ten inches, and the helical cylinder has a helix pitch angle of 20 degrees, a length of twelve inches and a diameter of five inches, and where the wire filaments are connected to the ground plate at the first end of the antenna.

6. The communications system of claim 5 wherein the length, diameter, pitch angle and ground plate connectivity cause the quadrifilar helix antennas to operate in a normal mode and produce a toroidal radiation pattern directed perpendicular to the central axis for UHF transmissions at 260 megahertz.

7. The communications system of claim 6 wherein the toroidal radiation pattern delivers a signal gain in a direction perpendicular to the central axis which is at least 23 dBi greater than a signal gain in an axial direction.

8. The communications system of claim 5 wherein the wire filaments have a wire diameter of 0.1 inches.

9. The communications system of claim 1 wherein the center feed wire is a coaxial cable with an inner conductor and an outer shield, and where a first opposing pair of the end branches is coupled to the inner conductor of the feed wire and a second opposing pair of the end branches is coupled to the outer shield.

10. The communications system of claim 1 wherein, for each of the quadrifilar helix antennas, the end branches and the wire filaments have an angular orientation about the central axis which is specified based on a location of the quadrifilar helix antenna on the circular pattern.

11. The communications system of claim 1 wherein the circular pattern has a diameter of 66 inches.

12. A communications system for a satellite comprising:

an L-band antenna aperture on an earth-facing deck of the satellite; and a cross-link subsystem providing ultra-high frequency (UHF) communications between the satellite and other satellites in an earth-orbiting constellation, said cross-link subsystem including eight quadrifilar helix antennas equally spaced in a circular pattern surrounding the L-band antenna aperture, where each of the quadrifilar helix antennas has a central axis which is parallel to an aiming direction of the L-band antenna aperture and perpendicular to the earth-facing deck, and where each of the quadrifilar helix antennas includes a ground plate, a feed wire in communication with a communications controller onboard the satellite, and four wire filaments formed in a helical cylinder.

13. The communications system of claim 12 wherein the L-band antenna aperture transmits global positioning system (GPS) signals toward earth in a cone-shaped radiation pattern with a cone opening angle of 28 degrees, and the eight quadrifilar helix antennas have a size and a location which causes them not to interfere with the GPS signals in the cone-shaped radiation pattern.

14. The communications system of claim 12 wherein the ground plate has a diameter of ten inches, and the helical cylinder has a helix pitch angle of 20 degrees, a length of twelve inches and a diameter of five inches, and where the wire filaments are connected to the ground plate.

15. The communications system of claim 14 wherein the length, diameter, pitch angle and ground plate connectivity cause the quadrifilar helix antennas to operate in a normal mode and produce a toroidal radiation pattern directed perpendicular to the central axis for UHF transmissions at 260 megahertz.

16. The communications system of claim 15 wherein the toroidal radiation pattern delivers a signal gain in a direction perpendicular to the central axis which is at least 23 dBi greater than a signal gain in an axial direction.

17. A cross-link subsystem for a satellite, said cross-link subsystem providing ultra-high frequency (UHF) communications between the satellite and other satellites in an earth-orbiting constellation, said cross-link subsystem comprising:

eight quadrifilar helix antennas equally spaced in a circular pattern surrounding an L-band antenna aperture on an earth-facing deck of the satellite, where each of the quadrifilar helix antennas has a central axis which is parallel to an aiming direction of the L-band antenna aperture and perpendicular to the earth-facing deck, and where each of the quadrifilar helix antennas includes;

a ground plate at a first end of the quadrifilar helix antenna proximal the earth-facing deck of the satellite, where the ground plate has a diameter of ten inches;

a center feed wire located along the central axis and in communication with a communications controller onboard the satellite, where the center feed wire is a coaxial cable with an inner conductor and an outer shield;

four wire filaments formed in a helical cylinder with a helix pitch angle of 20 degrees, where the cylinder has a length of twelve inches and a diameter of five inches, and where the wire filaments are connected to the ground plate at the first end of the antenna; and four end branches extending radially outward from the center feed wire at a second end of the antenna, where each of the end branches connects one of the wire filaments to the center feed wire, and where a first opposing pair of end branches is coupled to the inner conductor of the feed wire and a second opposing pair of end branches is coupled to the outer shield, and where the length, diameter, pitch angle and ground plate connectivity cause the quadrifilar helix antennas to produce a toroidal radiation pattern directed perpendicular to the central axis for UHF transmissions at 260 megahertz.

18. The cross-link subsystem of claim 17 wherein the L-band antenna aperture transmits global positioning system (GPS) signals toward earth in a cone-shaped radiation pattern with a cone opening angle of 28 degrees, and the eight quadrifilar helix antennas have a size and a location which causes them not to interfere with the GPS signals in the cone-shaped radiation pattern.

19. The cross-link subsystem of claim 17 wherein the toroidal radiation pattern delivers a signal gain in a direction perpendicular to the central axis which is at least 23 dBi greater than a signal gain in an axial direction.

20. The cross-link subsystem of claim 17 wherein, for each of the quadrifilar helix antennas, the end branches and the wire filaments have an angular orientation about the central axis which is specified based on a location of the quadrifilar helix antenna on the circular pattern.

* * * * *